US005669756A

United States Patent [19]

Brasz et al.

[11] Patent Number: 5,669,756

[45] Date of Patent: Sep. 23, 1997

[54] RECIRCULATING DIFFUSER

[75] Inventors: Joost J. Brasz, Fayetteville; John W. Salvage, Jamesville, both of N.Y.

[73] Assignee: Carrier Corporation, Syracuse, N.Y.

[21] Appl. No.: 663,329

[22] Filed: Jun. 7, 1996

[51] Int. Cl.[6] ..... F01D 5/04

[52] U.S. Cl. ..... 415/58.2; 415/47; 415/48

[58] Field of Search ..... 415/47, 48, 49, 415/58.2, 58.3, 148, 224.5

[56] References Cited

U.S. PATENT DOCUMENTS

| | | | |
|---|---|---|---|
| 4,219,305 | 8/1980 | Mount et al. . | |
| 4,363,596 | 12/1982 | Watson et al. | 415/47 |
| 4,378,194 | 3/1983 | Bandukwalla . | |
| 4,527,949 | 7/1985 | Kirtland . | |
| 5,059,091 | 10/1991 | Hatfield | 415/58.2 |
| 5,145,317 | 9/1992 | Brasz . | |
| 5,445,496 | 8/1995 | Brasz . | |

FOREIGN PATENT DOCUMENTS

| | | | |
|---|---|---|---|
| 842893 | 7/1952 | Germany | 415/58.2 |
| 682674 | 8/1979 | U.S.S.R. | 415/58.2 |

*Primary Examiner*—John T. Kwon

[57] ABSTRACT

A centrifugal compressor having an impeller wheel mounted for rotation about a central axis and a diffuser for emptying compressed fluid into a collector chamber. A plenum chamber is located behind the impeller shroud and series of deswirl passages are located about the impeller for placing the collector chamber in fluid flow communication with the plenum chamber. A series of channel flow passages are further arranged to inject compressor fluid in the plenum chamber into the exit flow leaving the tips of impeller blades under controlled conditions so that the injected fluid enters the exit flow smoothly and with little loss of energy. An adjustable control device regulates the flow through the deswirl passages to keep the total flow moving through the diffuser relatively constant under varying load conditions.

25 Claims, 4 Drawing Sheets

RECIRCULATING DIFFUSER

BACKGROUND OF THE INVENTION

This invention relates to a centrifugal compressor for use in a refrigeration system and in particular, to a centrifugal compressor containing a recirculating diffuser that is capable of operating efficiently over a wide load range.

Centrifugal compressors are typically used in large capacity chiller systems having water cooled condensers. The operating line for such compressors is very demanding. The Air Conditioning and Refrigeration Institute (ARI) certifies chiller systems when the manufacturer can show by testing that the compressor will perform in a range between full design capacity down to about 10% of full capacity without surging. The compressor operation is typically compared against a straight line plotted on the compressor map (head v. flow) known as the ARI line. The line slopes form the full capacity design point at 100% head at full capacity down to 50% head at 10% capacity. In order to meet this standard, some control must be exercised over the compressor to prevent the compressor from surging as the head and flow through the compressor are reduced. The most prominent ways to prevent surge is to vary the compressor speed or alter its geometry. Varying the compressor speed presents a number of problems and is typically not utilized. Accordingly, the speed of the compressor is fixed based on the particular design requirements of the system. By the same token, the impeller size is also fixed and adjustable inlet guide vanes are used to vary the compressor geometry. By adjusting the position of the inlet guide vanes, the flow through the compressor can be controlled to maintain high head pressures at lower capacities, and thus avoid surging. Even with adjustable inlet guide vanes, certain compressor instabilities are introduced by the fixed geometry impeller.

In addition to the instability produced by the fixed impeller design, the diffuser section of the compressor can also contribute to instability under partial load conditions. Diffusers having adjustable geometries have been employed with varying success to overcome this problem. These adjustable diffusers are shown in greater detail in U.S. Pat. No. 4,527,949; 4,378,194; and 4,219,305 wherein the flow through the diffuser is controlled by changing the area of the diffuser passage. Adjusting the area of some diffusers, such as pipe diffusers disclosed in U.S. Pat. No. 5,445,496 and 5,145,317 cannot be accomplished in a practical sense.

Higher compressor head pressures must be maintained in climatic areas such as the Asia—Pacific region, where the ambient temperatures remain relatively constant throughout the year. Under these conditions, with constant ambient wet-bulb temperatures of e.g. 85°, the compressor head can only fall to about 85% of the design head when operating at about 10% capacity. Accordingly, a compressor with excellent ARI load line performance does not necessarily operate efficiently or surge-free when called upon to operate at low capacities under these conditions.

Summary of the Invention

It is therefore an object of the present invention to improve centrifugal compressors.

It is a further object of the present invention to improve centrifugal compressors used in large chiller systems.

It is a still further object of the present invention to provide a centrifugal compressor for use in a chiller system that will operate below the surge line when the system is operating at about 10% of full load capacity.

Another object of the present invention is to provide a diffuser for use in a centrifugal compressor that will deliver a relatively constant flow through the diffuser under varying load conditions.

Yet another object of the present invention is to provide a system for controlling the flow through the diffuser of a centrifugal compressor when the area of the diffuser cannot be altered.

Still another object of the present invention is to provide a chiller system utilizing a centrifugal compressor that will operate in regions where the ambient temperatures remain relatively constant at a high level.

These and other objects of the present invention are attained by a centrifugal compressor having an impeller wheel, and a diffuser for expanding a compressed fluid into a collector chamber. The compressor further includes an annular plenum chamber located behind the compressor shroud and series of deswirl passages circumferentially mounted about the plenum chamber for delivering fluid from the collector chamber into the plenum chamber. A second series of channel vanes are mounted around the shroud adjacent the impeller tip region for introducing fluid contained in the plenum chamber into the flow leaving the impeller blades. A shut-off ring is adjustably mounted in the deswirl passages which is capable of moving from a fully opened position to a fully closed position to vary the flow through the deswirl passages. The positioning of the shut-off ring is controlled to maintain the total flow through the diffuser constant as the load demands on the system is reduced, thus avoiding surge at low capacities.

In one form of the invention, the shut-off ring acts in conjunction with adjustable inlet guide vanes to control the overall performance of a constant speed compressor to prevent the compressor form surging when the system is operating in high temperature climates at low capacity, that is, a capacity at about 10% of design capacity.

BRIEF DESCRIPTION OF THE DRAWINGS

For a better understanding of these and other objects of the present invention, reference shall be made to the following detailed description of the invention which is to be read in association with the following drawings, wherein.

DESCRIPTION OF THE INVENTION

Figure 1:
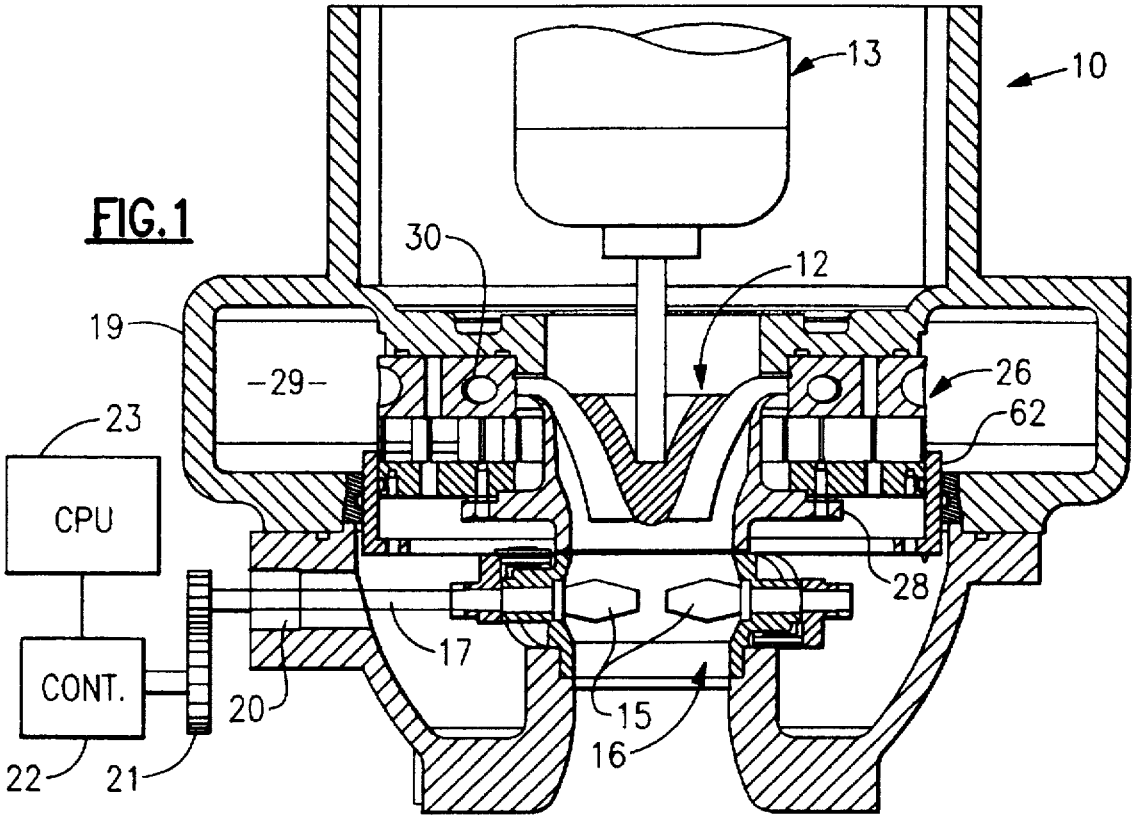
FIG. 1 is a side elevation in section showing a compressor embodying the present invention and further illustrating the adjustable shut-off ring at the entrance to the deswirl channels in a fully opened position.
Figure 2:
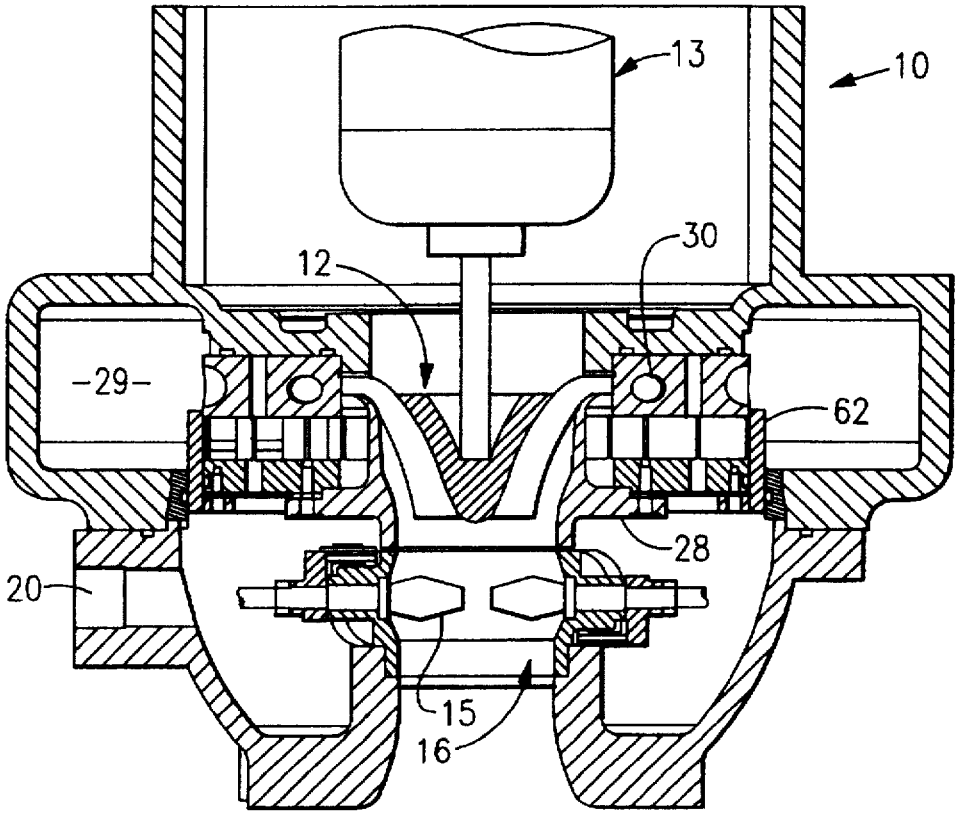
FIG. 2 is a side elevation similar to that of FIG. 1 illustrating the adjustable shut-off ring in a fully closed position.
Figure 3:
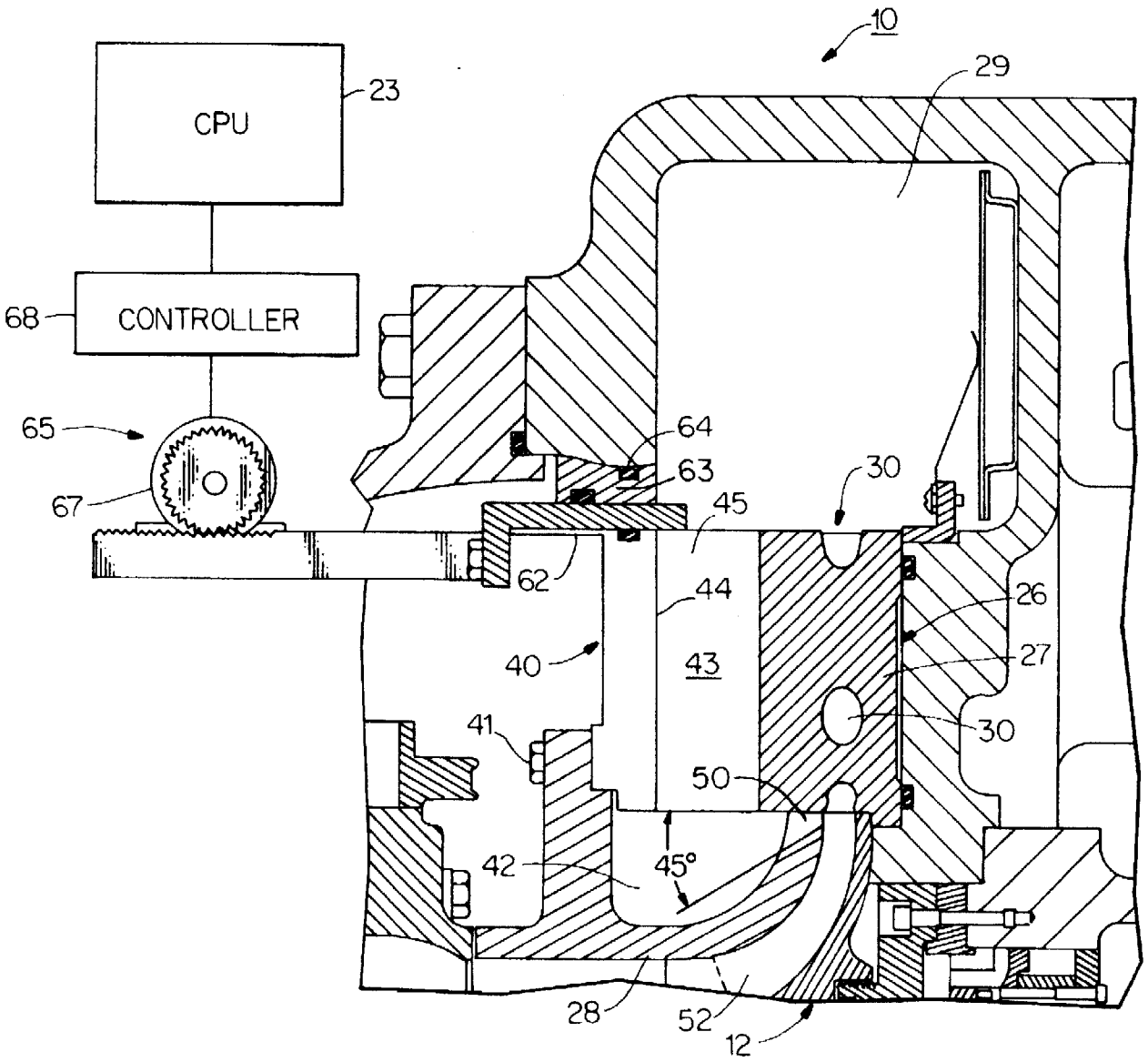
FIG. 3 is an enlarged partial side elevation showing in greater detail the diffuser recirculating circuit employed in the present invention.

Referring initially to FIGS. 1–3, there is shown a centrifugal compressor generally referenced 10 embodying the teachings of the present invention. The compressor employs a pipe diffuser having a fluid recirculating feature that accelerates fluid from the compressor discharge collector through a series of nozzles into the flow leaving the tip of the compressor impeller. The resulting volumetric flow rate at the diffuser entry reduces or eliminates the incidence losses that would otherwise occur without the recirculating feature. Since the fluid is injected at the impeller exit, no work is done on the fluid and the loss in efficiency and rise in fluid temperature found in other hot gas bypass methods is avoided. The compressor is a constant speed machine having a single impeller 12 that is driven directly by an electric motor 13, although any suitable drive may be similarly employed without departing from the teachings of the present invention. A series of adjustable inlet guide vanes 15—15 are mounted at the entrance 16 to the impeller. Each vane responds to a control shaft 17 that passes out of the compressor casing 19 through an opening 20. The control shaft is coupled via a gear train 21 to a controller 22. The controller, in turn, is arranged to adjust the setting of the inlet guide vanes in response to an input signal from a central processing unit (CPU) 23.

Under most operating conditions where the system is being used in moderate climates, the guide vanes will exercise sufficient control over the compressor so that the machine will not surge when operating at a low capacity. However, this is not the case when the system is forced to operate in climates where ambient wet bulb temperatures remain relatively constant. As noted above, the present compressor is equipped with a recirculating diffuser which serves to maintain the flow through the diffuser relatively constant despite changes in load demands.

Figure 4:
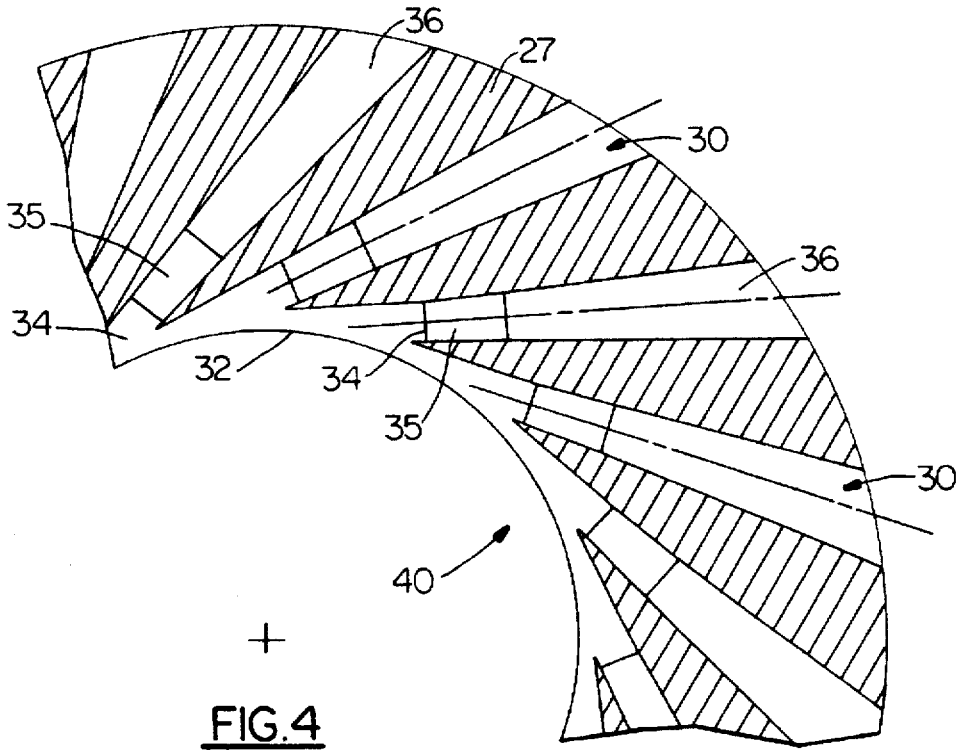
FIG. 4 is a further enlarged partial plan view showing the geometry of a pipe diffuser suitable for use in association with the present invention.

The fluid flow leaving the impeller is directed into a pipe diffuser section generally referenced 26. This type of pipe diffuser is described in greater detail in U.S. Pat. No. 5,445,496 owned by the current assignee which was filed in the name of Joost Brasz and the disclosure in the Brasz patent is incorporated herein by reference. As illustrated in FIG. 4, the pipe diffuser is formed of a single annular casting 27 which is supported upon the shroud 28 of the compressor. The casting as shown in FIG. 3 overlies the exit region of the impeller and extends radially to the rim of a collector chamber 29. A plurality of circumferentially spaced diffuser channels 30—30 are formed in the casing so that the centerlines 31—31 of the diffuser channels are tangent with a common circle 32 which, in this case, describes the inner rim of the casing. Each channel has three axially aligned cojoined sections 34–36. The first section 34 is cylindrical in form and is placed at an angle such that it intersects similar sections on either side thereof. An intermediate section 35 is joined in series with the cylindrical section and has a slightly divergent geometry in the direction of flow of about 4°. The last section 36 is joined to section 37 and is again flared in the direction of flow at an increased angle of about 8°.

It is desirable that the area at the exit to each channel be about 5 times that of the entrance area to insure that the compressed fluid leaving the impeller is, as near as possible, completely expanded before entering the collector chamber.

Figure 5:
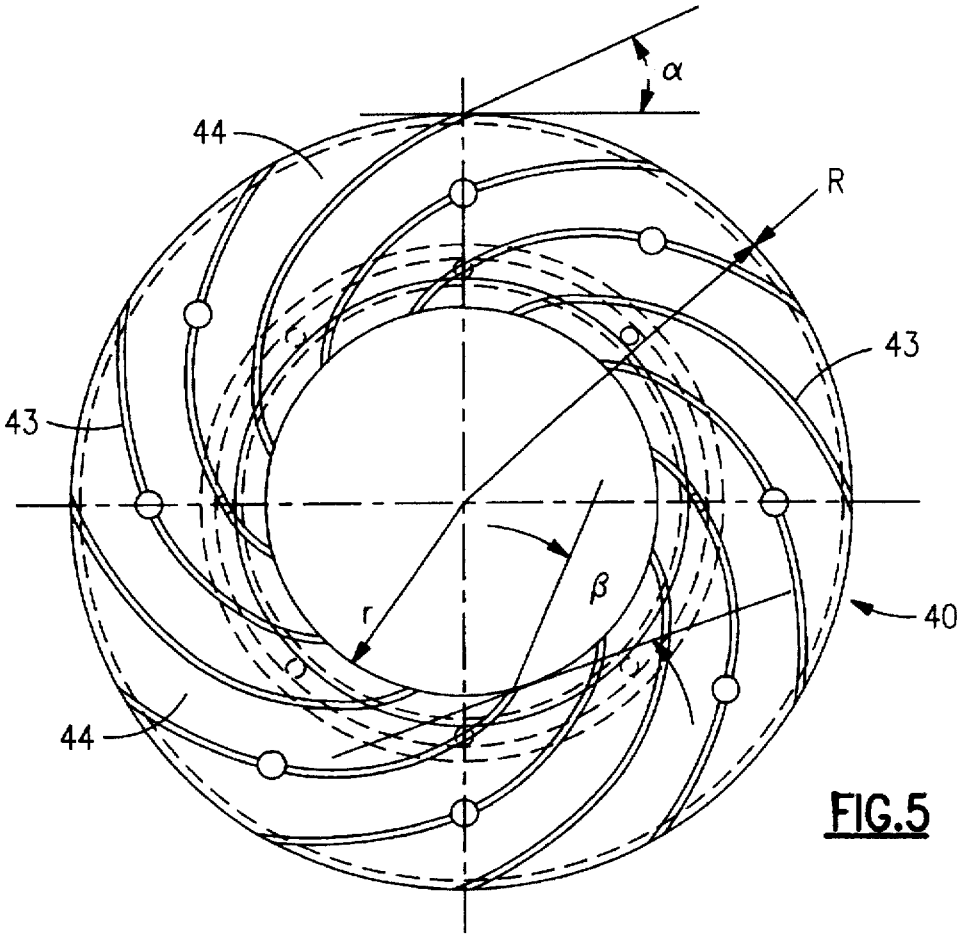
FIG. 5 is an enlarged plan view showing the deswirl vane assembly employed in the present invention.
Figure 7:
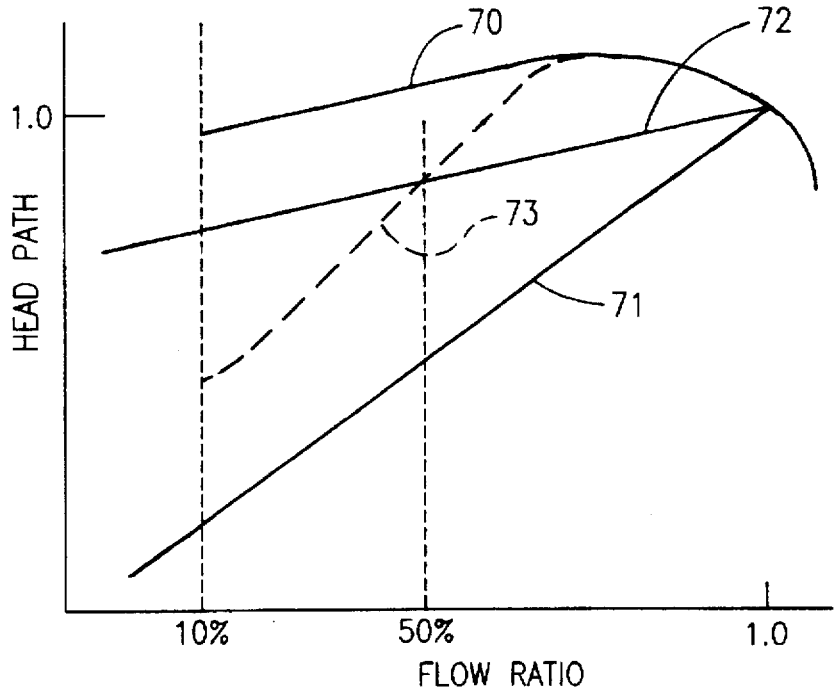
FIG. 7 is a diagram showing the surge characteristics of the present compressor wherein the compressor head is plotted against flow.

As best illustrated in FIGS. 3 and 5, an annular member 40 is mounted immediately adjacent to the diffuser casting 27 and is bolted to the shroud 28 by means of threaded fasteners 41. The shroud is contoured beneath the annular member to form a plenum chamber 42. The member includes a base 39 and a series of arcuate shaped deswirl vanes 43—43 mounted on its top face 44 of the base that combine to establish deswirl passages 45 between the blades for directing the high pressure expanded fluid from the collector chamber into the plenum chamber 41. With reference to FIG. 5, the vanes form an entrance angle $\alpha$ with a line that is tangent to a circle at radius R which is outer radius of the annular member 40. Preferably, the entrance angle is between 15° and 22°. The vanes also form an exit angle $\beta$ with a line that is tangent to a circle having a radius (r) which, in this case, is the inner radius of the disc. Preferably, the entrance angle is between 30° and 45°. The radius (R) represents the diffuser exit radius ±10% while the radius (r) represents the diffuser inlet radius ±10%. The deswirl passages are designed to remove most of the swirling action in the flow as it moves between the collector chamber and the plenum chamber.

Figure 6:
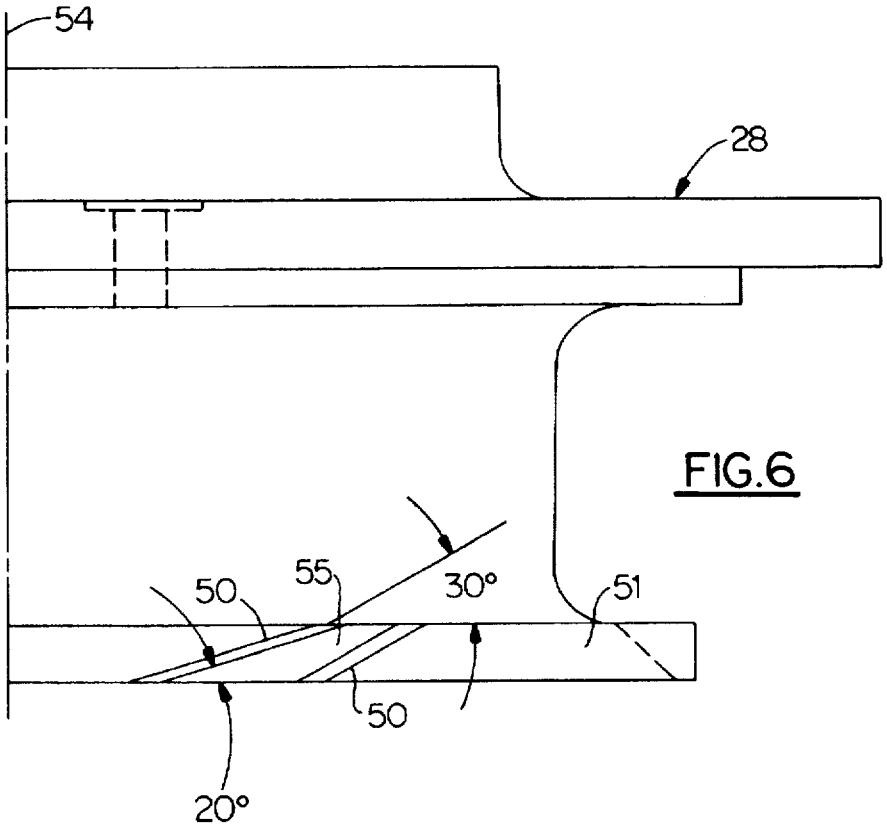
FIG. 6 is a partial side view of the impeller shroud further illustrating the geometry of the channel vanes utilized in the present invention.

FIG. 6 is a half top plan view of the shroud 28. A series of channel vanes 50 are mounted along a raised annular section 51 of the shroud that separates the plenum 42 and the impeller passages 52 (FIG. 3) The channel vanes are spaced circumferentially along the top part of the annular section and are arranged to establish passages 55 between the vanes for directing fluid from the plenum into the tip region of the impeller. The channel passages are contoured to accelerate the fluid flow moving therethrough to about that of the compressed fluid leaving the impeller. The channel passages also contour the flow passing therethrough at an angle corresponding to the direction of flow leaving the tip of the impeller whereby a smooth, low loss injection of fluid into the main fluid flow leaving the impeller is achieved.

A pair of adjacent channel vanes 50—50 are shown in FIG. 6 mounted along the top of the raised shroud section 51; the remaining vanes not being shown for the sake of clarity. The channel vanes have an inlet blade angle of about 30° and an exit blade angle of about 20° measured from the plane that is perpendicular to the axis 59 of the impeller. As seen in FIG. 3, the tip of the shroud section 57 located adjacent to the impeller is placed at an angle of about 45° so that the floor of the passages cooperates with the vanes to smoothly blend the fluid flow from the plenum chamber with that leaving the impeller.

A shut-off ring 62 (FIG. 3) is mounted at the entrance to the deswirl passages and is arranged to move between a fully opened position as shown in FIG. 1, whereby the passages are completely open to the collector chamber, and a fully closed position as shown in FIG. 2 whereby the flow between the collector chamber and the plenum chamber is effectively blocked. The ring is slidably mounted between a bearing 63 mounted in the compressor casing and the top surface of the deswirl member. Suitable seals 64 are provided that act against the ring to prevent high pressure fluids from escaping from the inside compressor. The ring is connected to a rack and pinion drive unit 65 which is arranged to selectively position the ring in an infinite number of positions between the fully opened and fully closed positions. The pinion wheel 67 is driven by means of a control unit 68 which, in turn, is programmed through the central processing unit 23. The ring drive system is programmed to operate in association with the inlet guide vanes so that the shut-off ring moves toward a closed position as the inlet guide vanes move toward an open position. The movement of the two control units are programmed through the CPU to maintain the compressor head relatively constant as the capacity of the compressor is reduced from the full load design capacity. Although the recirculating diffuser has been described in conjunction with adjustable inlet guide vanes to control the geometry of a centrifugal compressor, the recirculating diffuser can be used independently to attain similar results.

A compressor map of a centrifugal compressor equipped with the controls of the present invention is shown in FIG.

7 wherein compressor head is compared against flow. The surge line envelope of the compressor is shown at 70. Line 71 represents a compressor operating line where the condenser entering water temperature varies from 65° F. to 85° F. This line approximates the ARI line. A second line 72 is also plotted on the map which represents the compressor operating line where the condenser entering water temperature remains relatively constant at about 85° F. This the APO line. The dotted line 73 on the map further represents the surge line for a constant speed centrifugal compressor wherein the geometry of the compressor is controlled by inlet guide vanes. As can be seen, a compressor equipped with only adjustable inlet guide vanes will surge at about 50% capacity in a climate where the inlet water temperature to the condenser remains relatively constant at a high temperature. On the other hand, the same compressor equipped with a diffuser recirculating system embodying the teachings of the present invention will operate well above surge, even down to a capacity of about 10%. As should now be evident, the present compressor is ideally suited for use in large chiller systems used in climate areas when the condenser cooling water temperature remains relatively constant at or about 85° F.

Although the present invention is described with reference to a centrifugal compressor equipped with a pipe diffuser, it can be adapted for use equally as well with similar machines using any type of vaned diffusers such as a vane island diffuser or an air foil vaned diffuser.

While this invention has been explained with reference to the structure disclosed herein, it is not confined to the details set forth and this invention is intended to cover any modifications and changes as may come within the scope of the following claims:

What is claimed is:

1. A centrifugal compressor having an impeller wheel mounted for rotation about a central axis for compressing a fluid, and a diffuser for expanding the compressed fluid into a collector chamber, said compressor further including a plenum chamber contained in a shroud surrounding said impeller, a series of spaced apart deswirl blades circumferentially positioned about the impeller wheel and extending between the collector chamber and the plenum chamber for establishing a first set of deswirl flow passages for placing the collector chamber in fluid flow communication with the plenum chamber, a series of spaced apart channel vanes mounted in said plenum chamber about the impeller tip region for reestablishing a second set of channel flow passages for introducing fluid from the plenum chamber into the impeller exit flow, said first and second flow passages combining to adjust the fluid flow to about the exit speed and direction of fluid leaving the impeller, and control means for regulating the flow of fluid moving through the deswirl passages to regulate the amount of fluid introduced into said impeller exit flow and thus maintain the total flow moving through the diffuser relatively constant under varying load conditions.

2. The compressor of claim 1 wherein said control means further includes an adjustable ring mounted at the entrance to the deswirl chambers and ring drive means to move the ring through an infinite number of positions between a fully opened position and a fully closed position wherein flow through the deswirl chambers is terminated.

3. The compressor of claim 2 that further includes a series of adjustable guide vanes mounted within the impeller inlet region and guide vane drive means for opening and closing said guide means in response to compressor load conditions.

4. The compressor of claim 3, said control means further includes computer means for opening the adjustable ring as the adjustable guide vanes are closed to keep the flow of fluid through the compressor relatively constant under varying load conditions.

5. The compressor of claim 4 wherein said diffuser is made up of a series of circumferentially spaced diffuser pipes mounted adjacent to the blade tip region of said impeller.

6. The compressor of claim 5 wherein each pipe diffuser has a constant diameter entrance section, a center section that diverges in the direction of flow at a first angle and an exit section that diverges at a second angle that is greater than said first angle.

7. The compressor of claim 1 wherein the channel vanes are circumferentially mounted about the impeller blade tip region, each of said vanes forming an inlet angle of about 30° and an exit angle of about 20° measured from a plane that is perpendicular to the central axis of the impeller.

8. The compressor of claim 7 wherein the deswirl blades form an entrance angle of between 15° and 22° with a line tangent to the radius (R) of the entrance region and an exit angle of between 30° and 45° with a line tangent to the radius (r) of the exit region.

9. The compressor of claim 8 wherein (R) is equal to ±10% of the diffuser exit radius.

10. The compressor of claim 9 wherein (r) is equal to ±10% of the diffuser entrance radius.

11. A centrifugal compressor for use in a chiller system that includes an impeller wheel for compressing a refrigerant used in the system, a pipe diffuser, having an entry region for receiving compressed fluid exiting the impeller, for expanding compressed refrigerant exiting the impeller and delivering the refrigerant into a collector chamber, recirculating means for reintroducing refrigerant from the collector into the entry region of said pipe diffuser where the reintroduced refrigerant is blended with the compressed fluid leaving the impeller, and control means coupled to the recirculating means for regulating the amount of refrigerant passing through the recirculating means so that the total flow of refrigerant passing through the diffuser remains constant under varying loads.

12. The compressor of claim 11 wherein said recirculating means includes further means for accelerating the flow of refrigerant to about the velocity of the compressed fluid leaving the impeller.

13. The compressor of claim 12 that further includes means to contour the flow of recirculated refrigerant as it enters the flow of refrigerant leaving the impeller to minimize the amount of losses in the refrigerant.

14. The compressor of claim 11 wherein said recirculating means includes a first set of deswirl vanes arranged to establish deswirl passages for delivering refrigerant from the collector chamber into a plenum chamber adjacent to the impeller and a second set of channel vanes arranged to introduce refrigerant from the plenum chamber into the flow of compressed fluid leaving the impeller.

15. The compressor of claim 14 wherein the vanes are contoured to accelerate the speed of the recirculated refrigerant to about that of the refrigerant leaving the impeller.

16. The compressor of claim 15 wherein said second set of vanes are further contoured to turn the recirculated flow in the same direction as the flow leaving the impeller.

17. The compressor of claim 11 wherein said control means further includes an adjustable ring mounted at the entrance to the recirculating means and a drive means for selectively positioning the adjustable ring between a fully opened position and a fully closed position to vary the amount of flow through the recirculating means.

18. The compressor of claim 17 that further includes adjustable inlet guide means at the entrance to the impeller and positioning means for placing the vanes in a selected position between a fully opened and fully closed position.

19. The compressor of claim 18 that includes further programming means for coordinating the positioning of the inlet guide vanes and the adjustable ring so that the ring moves toward the fully closed position as the inlet guide means moves toward the fully opened position and the ring moves toward the fully closed position.

20. A method of controlling a centrifugal compressor that includes the steps of expanding the fluids leaving an impeller through a diffuser into a collection chamber, recirculating a portion of the refrigerant in the collector back to the entrance of the diffuser, and controlling the amount of recirculated fluid entering the diffuser in response to the load on the compressor to maintain the total amount of flow through the diffuser constant as the load on the compressor is varied.

21. The method of claim 20 that includes the further step of accelerating the speed of the recirculated fluid to about the speed of the fluid leaving the impeller.

22. The method of claim 21 that includes the further step of contouring the flow of recirculated fluid so that it blends into the flow leaving the impeller to minimize losses in the flow.

23. The method of claim 22 that includes the further step of reducing the amount of swirl in the recirculated fluid.

24. The method of claim 20 that further includes the step controlling the amount of flow entering the impeller of the compressor.

25. The method of claim 20 that includes the further step of reducing the amount of the recirculated flow in response to an increase in the amount of inlet flow to the impeller and correspondingly increasing the amount of the recirculating flow in response to a decrease in the inlet flow to the impeller to maintain the flow through the diffuser constant as the load on the compressor is varied.

* * * * *